US005628297A

United States Patent [19]

Taruya et al.

[11] Patent Number: 5,628,297

[45] Date of Patent: May 13, 1997

[54] IGNITION APPARATUS FOR INTERNAL COMBUSTION ENGINE

[75] Inventors: Masaaki Taruya; Mitsuru Koiwa, both of Tokyo, Japan

[73] Assignee: Mitsubishi Denki Kabushiki Kaisha, Tokyo, Japan

[21] Appl. No.: 626,328

[22] Filed: Apr. 2, 1996

[30] Foreign Application Priority Data

Apr. 24, 1995 [JP] Japan ..... 7-098811

[51] Int. Cl.[6] ..... F02P 3/02

[52] U.S. Cl. ..... 123/634; 123/647

[58] Field of Search ..... 123/635, 647, 123/634

[56] References Cited

U.S. PATENT DOCUMENTS 5,186,154 2/1993 Takaishi et al. ..... 123/647 X

FOREIGN PATENT DOCUMENTS 4-77220 7/1992 Japan .
5-79444 3/1993 Japan .

*Primary Examiner*—Tony M. Argenbright
*Attorney, Agent, or Firm*—Sughrue, Mion, Zinn, Macpeak & Seas

[57] ABSTRACT

An ignition apparatus for an internal combustion engine includes a power switch 16 for intermittently feeding a primary current to an ignition coil, and primary and secondary coils 5, 6 of the ignition coil contained in an insulation case 1 with the power switch and fixed by an insulating resin material 15 poured into the case. An insulating member 21 is interposed between the secondary coil 6 and the power switch 16 for suppressing thermal flow between the secondary coil 6 and the power switch 16. with this arrangement, a temperature increase caused by thermal interference between the ignition coil and the power switch is thus suppressed.

3 Claims, 10 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine arranged such that a power switch for intermittently feeding a primary current to an ignition coil and a primary coil and a secondary coil of the ignition coil are contained in an insulation case and the power switch, the primary coil and the secondary coil are fixed by an insulating resin material poured into the insulation case.

2. Description of the Related Art

FIG. 11 is an overall perspective view of a conventional ignition apparatus for internal combustion engine disclosed in Japanese Utility Model Laid-Open No. 4-77220, FIG. 12 is a longitudinal sectional view of the ignition apparatus of FIG. 11, FIG. 13 is a perspective view of an insulation case of FIG. 11 and FIG. 14 is an electric circuit diagram of the ignition apparatus for internal combustion engine. In the drawings, a hole 1*b* is defined in the bottom of the accommodating section 1*a* of a synthetic resin insulation case 1 at the center thereof. The central portion of a first E-shaped iron core 2 of an ignition coil extends through the hole 1*b*. A second E-shaped iron core 3 of the ignition coil is spaced apart from the first E-shaped iron core 2 in confrontation therewith. A primary coil 5 is wound on a bobbin 4 around the central portions of the first and second iron cores 2,3. The ignition coil has a secondary coil 6 wound around the outer periphery of the primary coil 5 thereof.

A power switch 7 is accommodated in an auxiliary accommodating section 1*c* projecting from the accommodating section 1*a*. The power switch 7 includes a tray-shaped iron metal case 8, a switching device 9 composed of a power transistor accommodated in the metal case 8, a hybrid integrated circuit (hybrid IC) 10 for driving and controlling the switching device 9, a silicon gel 11 filled into the metal case 8 for protecting the switching device 9 and the hybrid integrated circuit 10, and a lid 12 for sealing the interior of the metal case 8.

The insulation case 1 includes a holding section for a high-tension terminal 13 and a holding section 1*e* for a low-tension terminal section 14. The low-tension terminal section 14 includes a first low-tension terminal 14*a* for connecting the primary coil 5 to the battery of an automobile, a second low-tension terminal 14*b* for imposing an ignition signal from a control unit (not shown) on the power switch 7, and a third ground low-tension terminal 14*c*. Note, the accommodating section 1*a* and auxiliary accommodating section 1*c* of the insulation case 1 are filled with an insulating resin material 15 which may be cured epoxy resin.

In the ignition apparatus for the internal combustion engine arranged as described above, a primary current flowing to the primary coil 5 of the ignition coil is controlled through the power switch 7 in response to an ignition signal which is input from the second low-tension terminal 14*b* through the control unit. A high-tension voltage is generated to the secondary coil 6 of the ignition coil in accordance with the primary current flowing to the primary coil 5 and fed to a distributor (not shown).

In this example, the metal case 8 is used to secure the heat radiation property of the power switch 7 and powder of alumina or the like having a good thermal conductivity is contained in the insulating resin material 15 so that heat generated from the power switch 7 is uniformly diffused to the overall metal case 8 and discharged to the outside air through the insulating material 15 and insulation case 1.

In the conventional ignition apparatus for the internal combustion engine, heat generated by the operation of the power switch 7 is liable to be radiated to the outside by the radiating action of the metal case 8. However, when heat generated by the operation of the ignition coil is discharged to the outside air through the overall surface of the insulation case 1, a problem arises in that the power switch 7 located in an intermediate portion of heat path is affected by the heat from the ignition coil and the temperature thereof is increased. As a result, the power switch 7 may malfunction.

SUMMARY OF THE INVENTION

An object of the present invention made to solve the above problem is to provide an ignition apparatus for an internal combustion engine capable of suppressing a temperature increase caused by thermal interference between the power switch and the ignition coil.

Accordingly, an ignition apparatus for an internal combustion engine of the present invention comprises: an ignition coil; a power switch for intermittently feeding a primary current to said ignition coil; an insulating case filled with an insulating resin material and containing therein said ignition coil and said power switch; and a thermal interference suppresion means disposed between said igniton coil and said power switch to suppress thermal interference between said igniton coil and said power switch.

DESCRIPTION OF PREFERRED EMBODIMENTS

Embodiment 1

Figure 1:
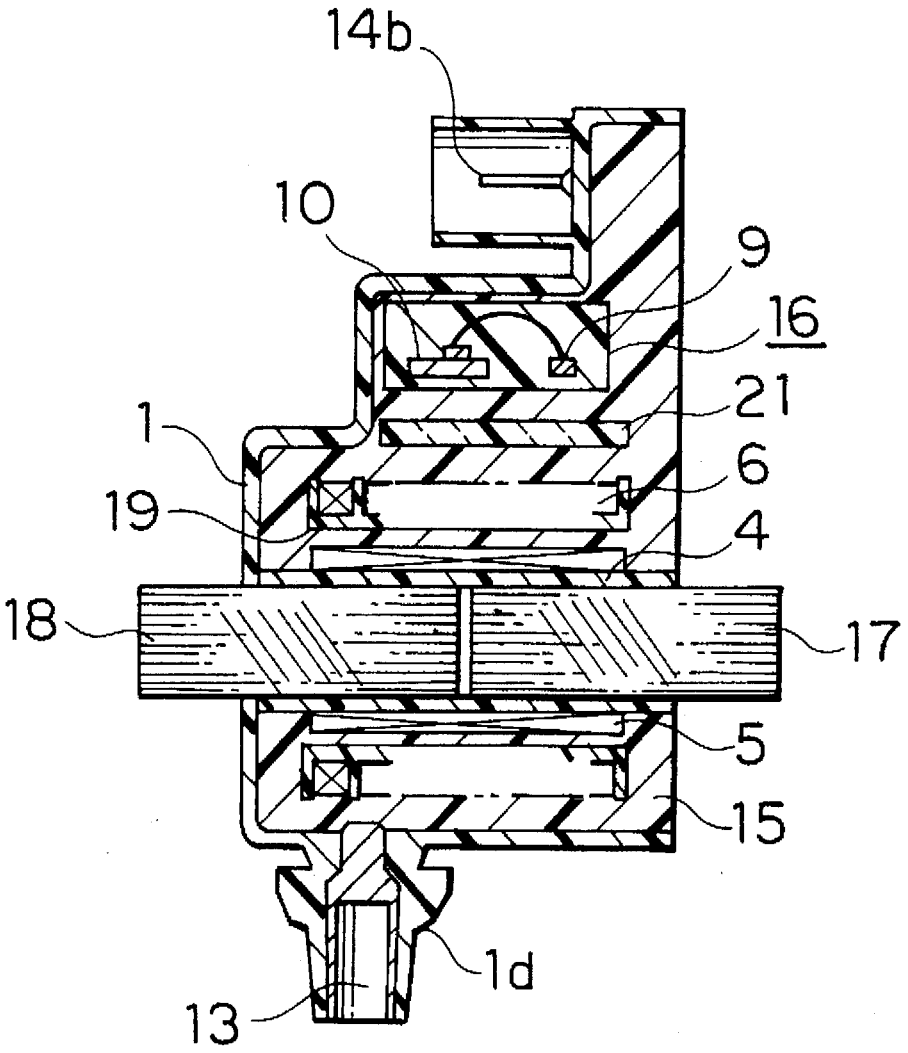
FIG. 1 is a sectional front view showing an embodiment of an ignition apparatus for an internal combustion engine according to the present invention.
Figure 2:
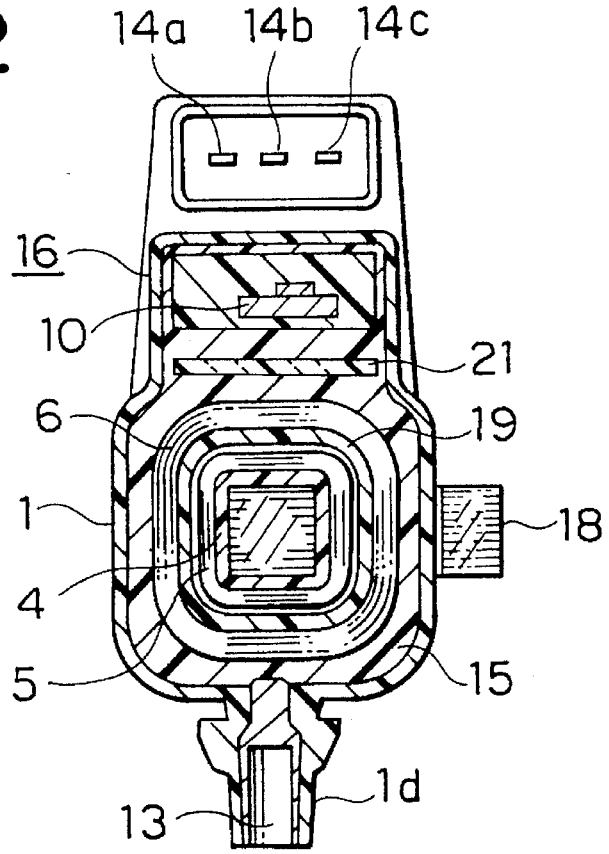
FIG. 2 is a sectional side view of FIG. 1.

FIG. 1 is a sectional front view showing an embodiment of an ignition apparatus for an internal combustion engine according to the present invention and FIG. 2 is a side cross sectional view of FIG. 1, wherein the same numerals as used in FIG. 11 to FIG. 14 are used to denote the same or corresponding parts and the description thereof will be omitted.

In the embodiment 1, a power switch 16 is composed of a switching device 9 composed of a power transistor and a hybrid integrated circuit (hybrid IC) 10 for driving and controlling the switching device 9 which are encapsulated by a resin as a single unitary member by insert molding. A primary coil 5 and a secondary coil 6 are wound around an iron core composed of a first C-shaped iron core 17 and a second C-shaped iron core 18. A rubber heat insulating member 21, for example, as heat interference suppression means is interposed between the power switch 16 and the secondary coil 6. As a result, when the heat generated by the secondary coil 6 is transmitted toward the power switch 16, the transmission of the heat is interfered by the heat insulating member 21. Therefore, the power switch 16 is difficult to be affected by the heat from the secondary coil 6, the temperature increase of the power switch 16 caused by the heat generated by the secondary coil 6 is suppressed, and the malfunction of the power switch 16 caused by the effect of heat can be prevented.

When the heat generated by the power switch 16 is transmitted toward the secondary coil 6, the transmission of the heat is prevented by the heat insulating member 21 and the secondary coil 6 is difficult to be affected by the heat from the power switch 16. Therefore, the temperature increase of the secondary coil 6 caused by the heat generated by the power switch 16 is suppressed, so that the deterioration of the insulating performance of the secondary coil 6 and the deformation of a bobbin 19 can be prevented.

Embodiment 2

Figure 3:
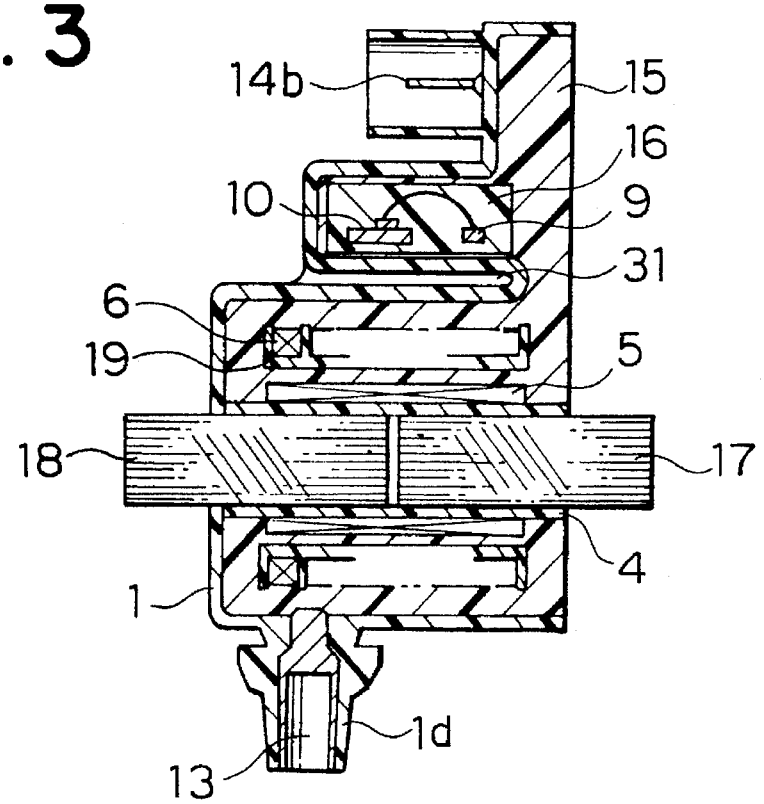
FIG. 3 is a sectional front view showing another embodiment of the ignition apparatus for the internal combustion engine according to the present invention.
Figure 4:
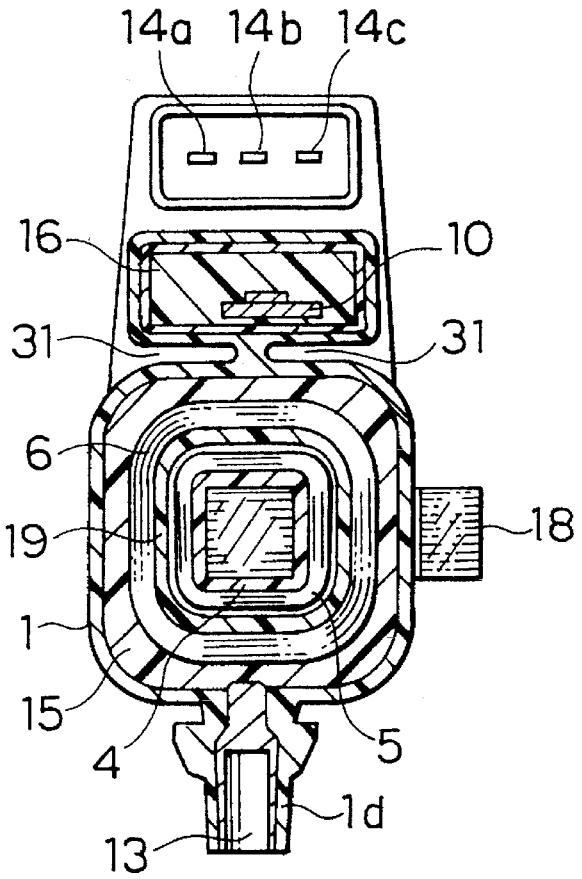
FIG. 4 is a sectional side view of FIG. 3.

FIG. 3 is a sectional front view showing another embodiment of the ignition apparatus for the internal combustion engine according to the present invention and FIG. 4 is a sectional side view of FIG. 3, wherein an air layer 31 as thermal interference suppression means is interposed between the power switch 16 and the secondary coil 6. The air layer 31 is formed simultaneously with the formation of the insulation case 1.

In the embodiment 2, when heat tends to be transmitted, for example, from the secondary coil 6 to the power switch 16, since the air layer 31 acts as a large thermal resistor, the temperature increase of the power switch 16 caused by the effect of the heat from the secondary coil 6 is suppressed. Likewise, the temperature increase of an ignition coil caused by the effect of heat from the power switch 16 is also suppressed.

Embodiment 3

Figure 5:
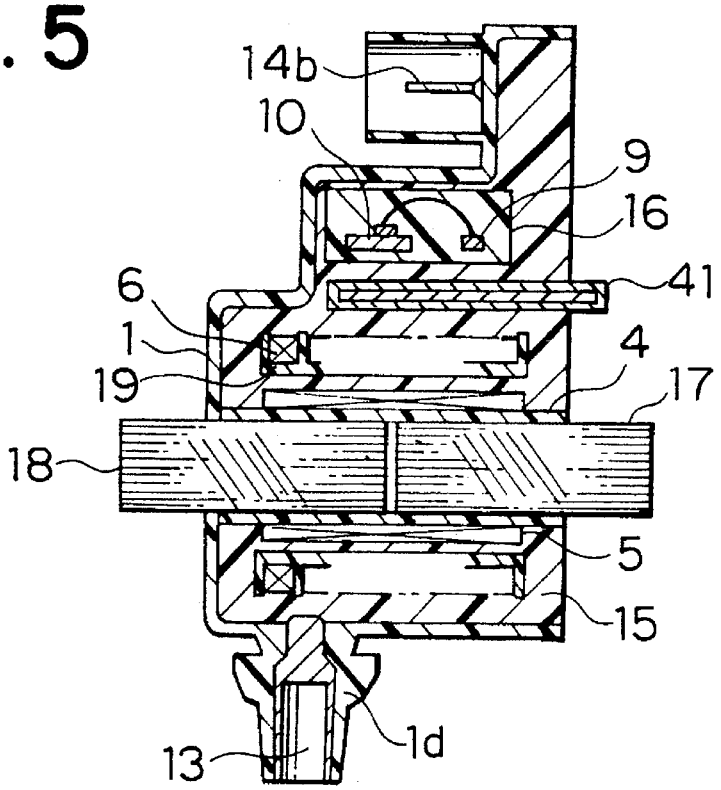
FIG. 5 is a sectional front view showing still another embodiment of the ignition apparatus for the internal combustion engine according to the present invention.
Figure 6:
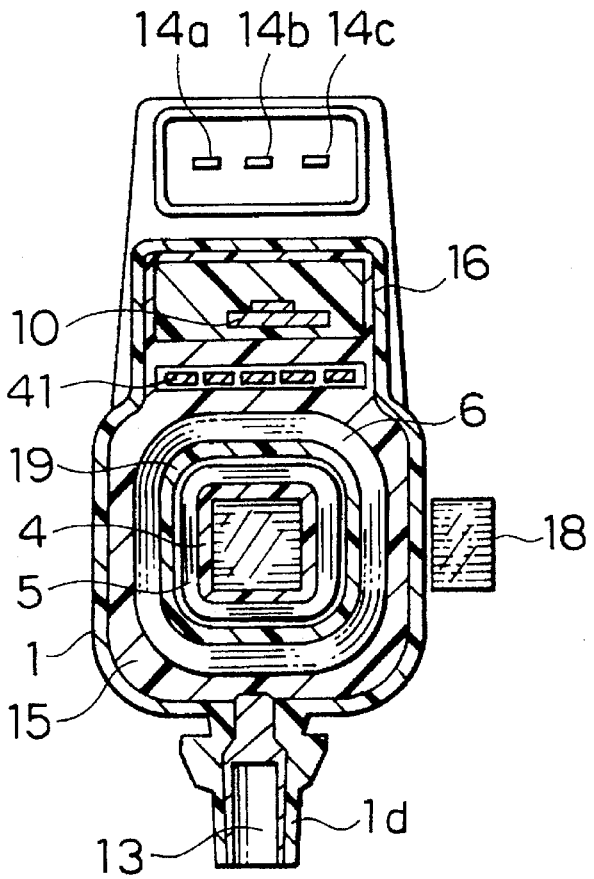
FIG. 6 is a sectional side view of FIG. 5.

FIG. 5 is a sectional front view showing still another embodiment of the ignition apparatus for internal combustion engine according to the present invention and FIG. 6 is a sectional side view of FIG. 5, wherein a plurality of heat pipes 41 as thermal interference suppression means each having an end exposed to the outside air are interposed between the power switch 16 and the secondary coil 6. As a result, the heat generated from the secondary coil 6 and the power switch 16 is positively discharged to the outside air through the heat pipes 41 using, for example, methanol as a heat-conveying liquid, so that the heat increase of each of the power switch 16 and the secondary coil 6 is suppressed.

Embodiment 4

Figure 7:
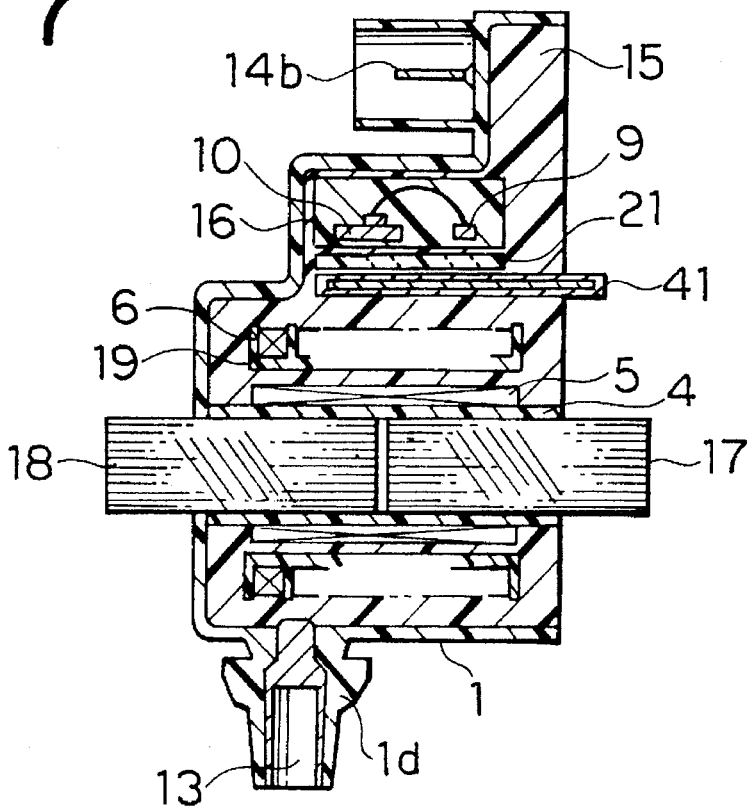
FIG. 7 is a sectional side view showing a further embodiment of the ignition apparatus for the internal combustion engine according to the present invention.
Figure 8:
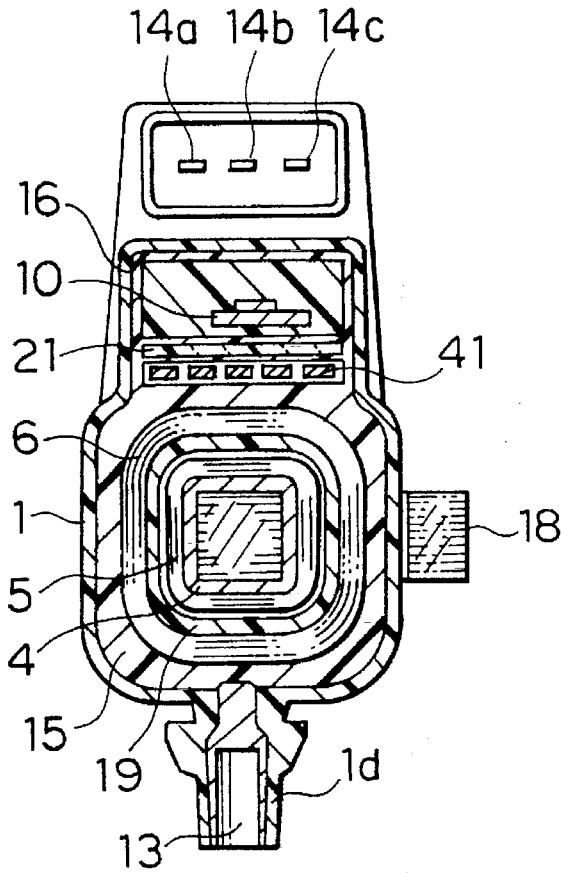
FIG. 8 is a sectional side view of FIG. 7.

FIG. 7 is a sectional front view showing a further embodiment of the ignition apparatus for the internal combustion engine according to the present invention and FIG. 8 is a sectional side view of FIG. 7, wherein a plurality of heat pipes and an heat insulating member 21 which constitute the thermal interference suppression means are interposed between the power switch 16 and the secondary coil 6. The heat pipes 41, with the ends thereof exposed to the outside air, are located closer to the secondary coil 6 than the heat insulating menbar 21, and the secondary coil 6 which is operated at a temperature higher than a temperature at which the power switch 16 is operated.

In the embodiment 4, when the power switch 16 operates at 100° C. and the secondary coil 6 operates at 140° C., for example, although a part of the heat generated by the secondary coil 6 is to be transmitted toward the power switch 16 from the secondary coil 6, the heat is positively discharged to the outside air through the heat pipes 41, thereby to lower the operation temperature of the secondary coil 6. As a result, a temperature gradient between the secondary coil 6 and the power switch 16 is sequently lowered, so that an amount of heat transmitted from the secondary coil 6 to the power switch 16 is reduced as well as the transmission of the heat is prevented by the heat insulating member 21. Therefore, the power switch 16 is difficult to be affected by the heat from the secondary coil 6, thus the temperature increase of the power switch 16 caused by the heat generated by the secondary coil 6 is suppressed.

Embodiment 5

Figure 9:
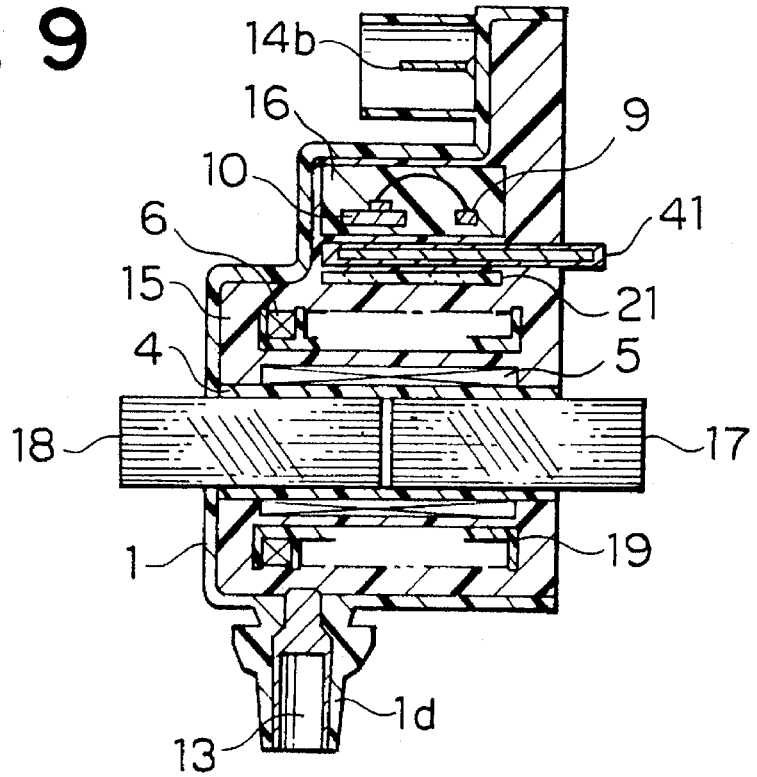
FIG. 9 is a sectional front view showing a still further embodiment of the ignition apparatus for the internal combustion engine according to the present invention.
Figure 10:
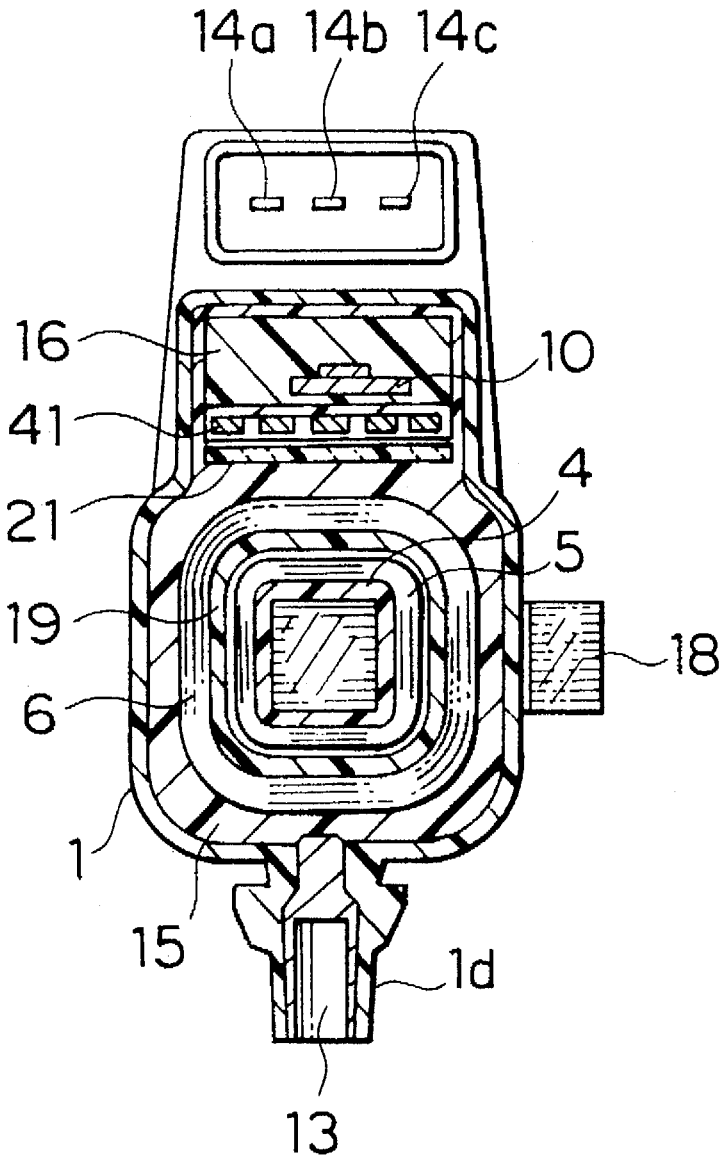
FIG. 10 is a sectional side view of FIG. 9.
Figure 11:
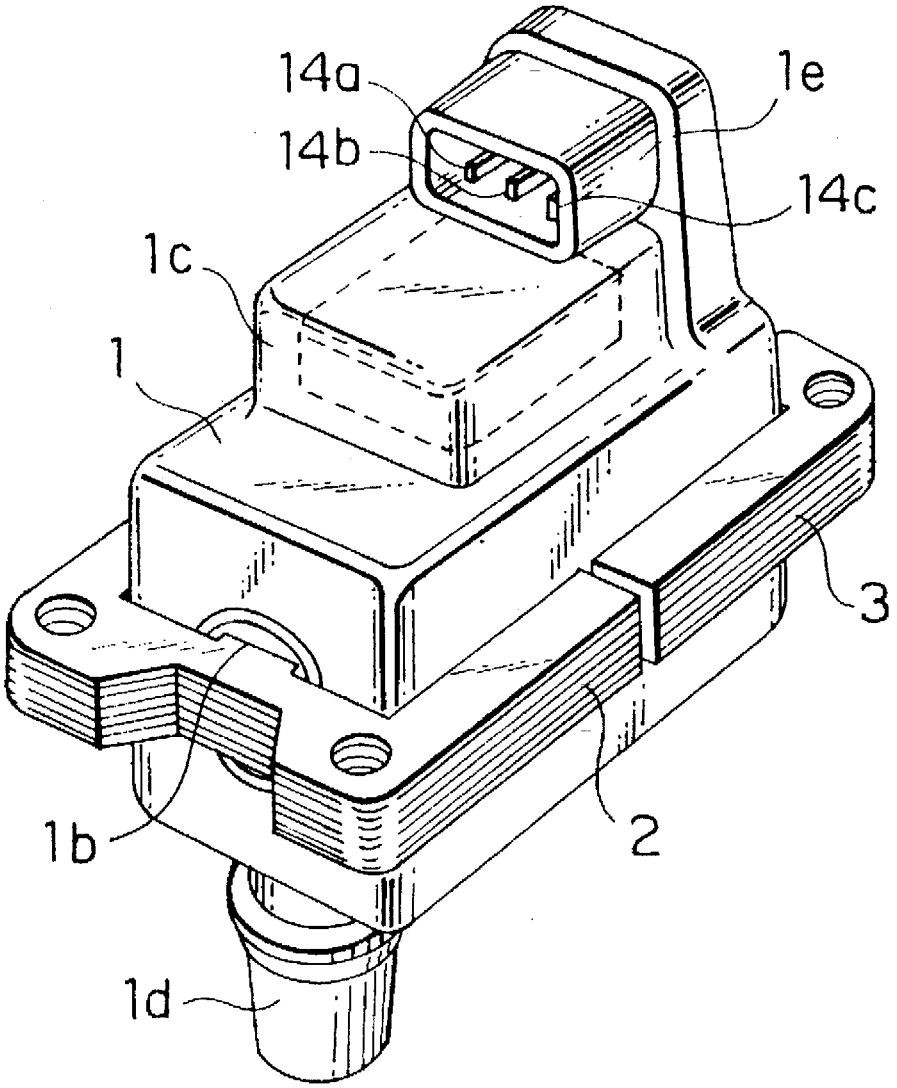
FIG. 11 PRIOR ART
FIG. 11 is an overall perspective view showing an example of a conventional ignition apparatus for an internal combustion engine.
Figure 12:
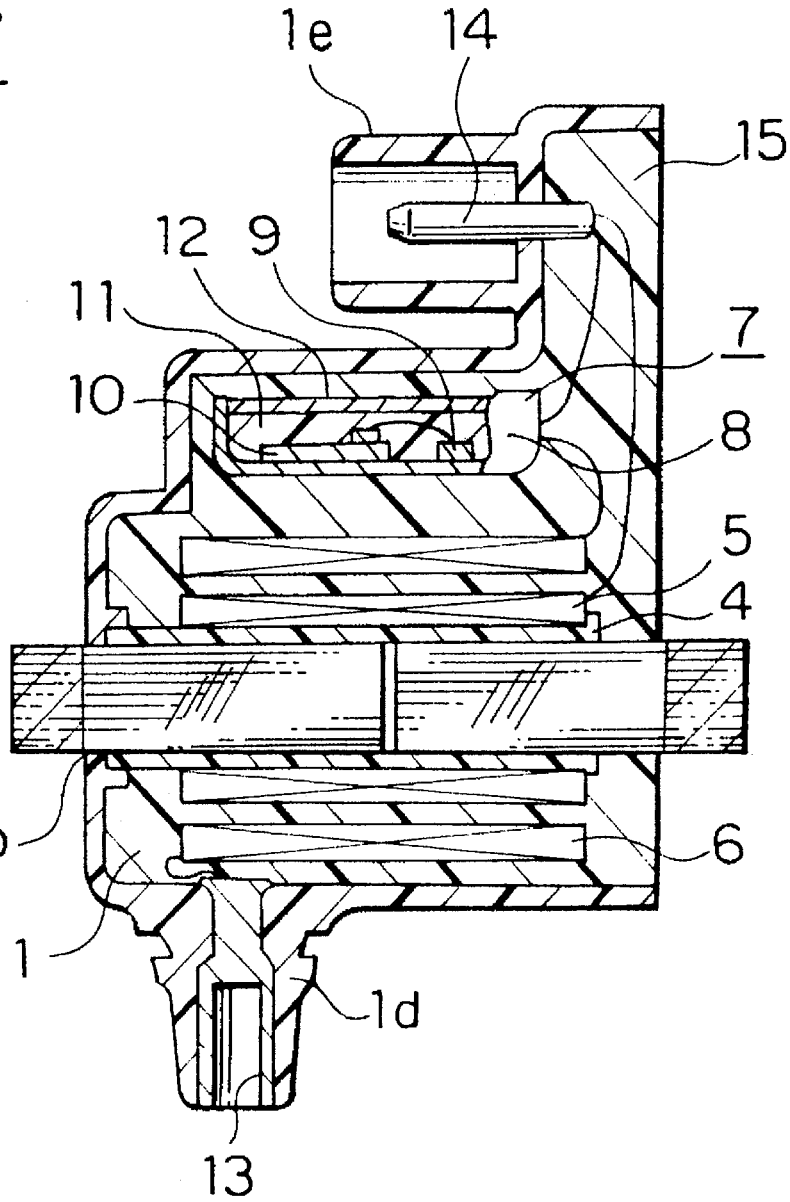
FIG. 12 PRIOR ART
FIG. 12 is a longitudinal sectional view of FIG. 11.
Figure 13:
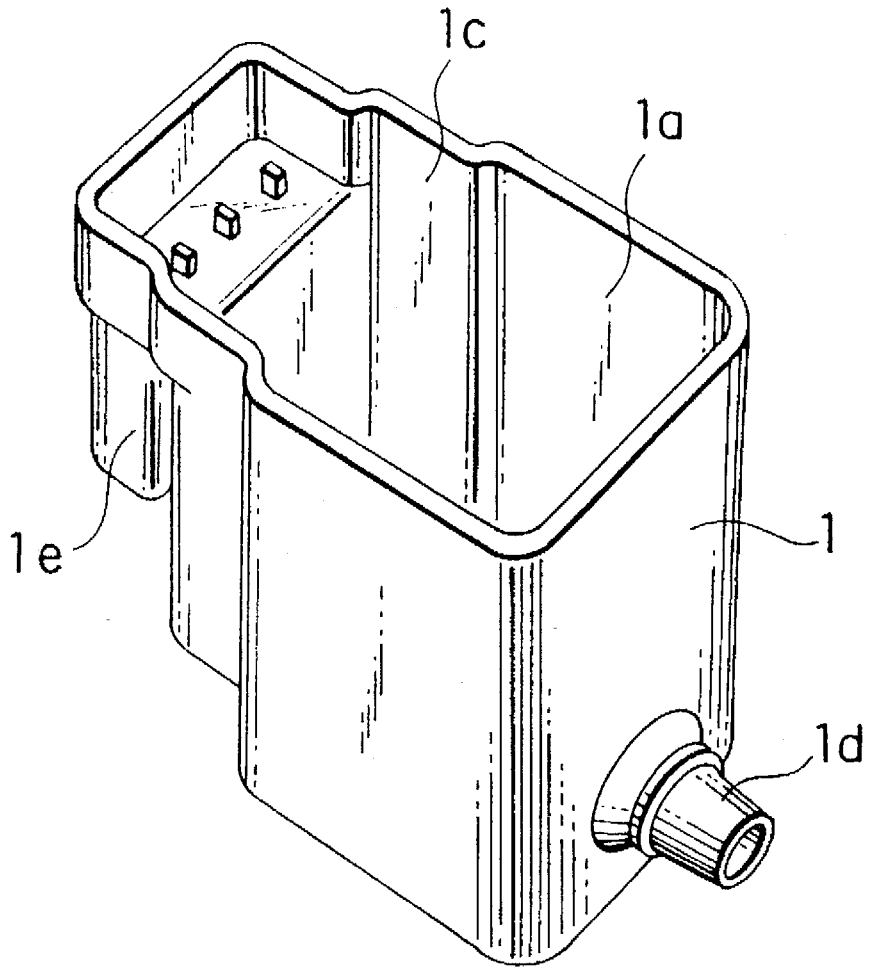
FIG. 13 PRIOR ART
FIG. 13 is a perspective view of an insulation case shown in FIG. 11.
Figure 14:
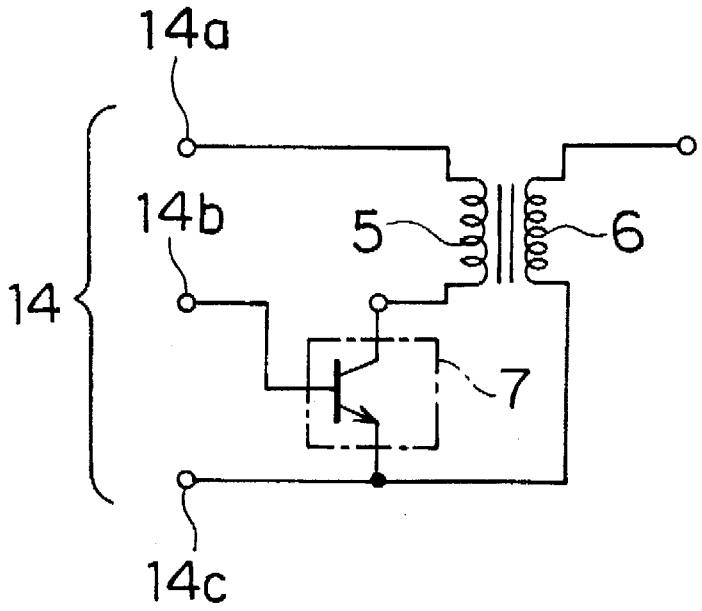
FIG. 14 PRIOR ART
FIG. 14 is an electric circuit diagram of the ignition apparatus for the internal combustion engine.

FIG. 9 is a sectional front view showing a still further embodiment of the ignition apparatus for the internal combustion engine according to the present invention and FIG. 10 is a side cross sectional view of FIG. 9. The embodiment 5 is different from FIG. 4 in that the heat pipes 41 are disposed closer to the power switch 16 and the heat insulating member 21 is disposed closer to the secondary coil 6.

In the embodiment 5, since the power switch 16 is operated at a temperature higher than a temperature at which the secondary coil 6 is operated, heat generated from the power switch 16 can be positively discharged to the outside air through the heat pipes 41 as well as the transmission of heat toward the secondary coil 6 is prevented by the heat insulating member 21, so that the secondary coil 6 is difficult to be affected by the heat from the power switch 16 and the temperature increase of the secondary coil 6 caused by the heat generated by the power switch 16 is suppressed.

As described above, according to the ignition apparatus for the internal combustion engine of the present invention, since the thermal interference suppression means is interposed between the ignition coil and the power switch, thermal interference between the ignition coil and the power switch is suppressed, thus there is an advantage, for example, that the temperature increase of the power switch caused by heat from the ignition coil can be suppressed.

When the heat insulating member is used as the thermal interference suppression means, there is an advantage that thermal interference between the ignition coil and the power switch can be suppressed by a less expensive material having a simple structure.

When the air layer formed by indentation of the insulation case is used as the thermal interference suppression means, there is an advantage that a dedicated member for suppressing thermal interference between the ignition coil and the power switch is not needed and the air layer can be simply formed when an insulation case is formed.

When the heat pipes each having an end exposed to the outside air are used as the heat interference suppression means, there is an advantage that heat between the ignition coil and the power switch is positively discharged to the outside and thermal interference therebetween is suppressed.

Further, when the heat pipes each having an end exposed to the outside air and the insulating member are arranged as the thermal interference suppression means with the heat pipes disposed on the high temperature side and the heat insulating member disposed on the low temperature side, there is an advantage that a temperature gradient between the ignition coil and the power switch is consequently lowered and the thermal interference between the ignition coil and the power switch is suppressed to a low level by the cooperation of the heat pipes and the heat insulating member.

What is claimed is:

1. An ignition apparatus for an internal combustion engine comprising: an ignition coil; a power switch for intermittently feeding a primary current to said ignition coil; an insulating case filled with an insulating resin material and containing therein said ignition coil and said power switch; and a thermal interference suppression means disposed between said ignition coil and said power switch to suppress thermal interference between said ignition coil and said power switch, wherein said thermal interference suppression means is composed of a heat insulating member.

2. An ignition apparatus for an internal combustion engine comprising: an ignition coil; a power switch for intermittently feeding a primary current to said ignition coil; an insulating case filled with an insulating resin material and containing therein said ignition coil and said power switch; and a thermal interference suppression means disposed between said ignition coil and said power switch to suppress thermal interference between said ignition coil and said power switch, wherein said thermal interference suppression means is composed of heat pipes each having an end exposed to the outside air.

3. An ignition apparatus for an internal combustion engine comprising: an ignition coil; a power switch for intermittently feeding a primary current to said ignition coil; an insulating case filled with an insulating resin material and containing therein said ignition coil and said power switch; and a thermal interference suppression means disposed between said ignition coil and said power switch to suppress thermal interference between said ignition coil and said power switch, wherein said thermal interference suppression means is composed of heat pipes each having an end exposed to the outside air and a heat insulating member, said heat pipes being located closer than said heat insulating member to one of said power switch and said ignition coil which is operated at a higher temperature.

* * * * *